US007554503B2

(12) United States Patent
Hsu et al.

(10) Patent No.: US 7,554,503 B2
(45) Date of Patent: Jun. 30, 2009

(54) WIDE BAND ANTENNA

(75) Inventors: Cheng-Hsuan Hsu, Hsin-Tien (TW); Sheng-Chih Lin, Hsin-Tien (TW); Tsung-Wen Chiu, Hsin-Tien (TW); Fu-Ren Hsiao, Hsin-Tien (TW)

(73) Assignee: Advanced Connectek Inc., Taipei Hsien (TW)

( * ) Notice: Subject to any disclaimer, the term of this patent is extended or adjusted under 35 U.S.C. 154(b) by 0 days.

(21) Appl. No.: 12/014,269

(22) Filed: Jan. 15, 2008

(65) Prior Publication Data

US 2008/0174496 A1 Jul. 24, 2008

(30) Foreign Application Priority Data

Jan. 19, 2007 (TW) ..... 96102098 A

(51) Int. Cl.

*H01Q 13/10* (2006.01)
*H01Q 1/38* (2006.01)
*H01Q 5/00* (2006.01)
*H01Q 9/04* (2006.01)

(52) U.S. Cl. ..... 343/767; 343/700 MS

(58) Field of Classification Search ..... 343/767, 343/700 MS

See application file for complete search history.

(56) References Cited

U.S. PATENT DOCUMENTS 7,248,224 B2 * 7/2007 Yuanzhu ..... 343/700 MS
7,352,329 B2 * 4/2008 Chung et al. ..... 343/700 MS
2003/0103010 A1 6/2003 Boyle
2005/0128151 A1 * 6/2005 Kwak et al. ..... 343/702
2005/0259024 A1 * 11/2005 Hung et al. ..... 343/770
2006/0033668 A1 * 2/2006 Ryu ..... 343/702
2007/0132640 A1 * 6/2007 Kim et al. ..... 343/700 MS
2008/0198088 A1 * 8/2008 Lin et al. ..... 343/850
2009/0040113 A1 * 2/2009 Tseng et al. ..... 343/700 MS

* cited by examiner

*Primary Examiner*—Vibol Tan
*Assistant Examiner*—Dylan White
(74) *Attorney, Agent, or Firm*—Rabin & Berdo, P.C.

(57) ABSTRACT

A wide band antenna has a ground plane, a dielectric member and a radiating patch. The dielectric member is mounted on the ground plane. The radiating patch is held by the dielectric member, is mounted on the ground plane and has a main conductor, a feeding conductor, a coupling conductor, an extension conductor and a shorting conductor. The main conductor has a first resonant mode. The extension conductor has a second resonant mode. The coupling conductor is capable of feeding high frequency signals into the main conductor and the extension conductor by capacitive coupling effect. With the main conductor, the extension conductor and the coupling conductor, the size of the wide band antenna is effectively reduced.

14 Claims, 8 Drawing Sheets

WIDE BAND ANTENNA

BACKGROUND OF THE INVENTION

1. Field of the Invention

The present invention relates to an antenna, and more particularly to a wide band antenna that has multiple resonant modes and sufficient bandwidths.

2. Description of Related Art

Wireless telecommunication technologies develop rapidly recently years and various wireless products are marketed popularly. One of most important components in wireless product is an antenna. The quality of an antenna directly effects the stability of the communication of the wireless product with other wireless devices. Due to various wireless products are implemented under different wireless telecommunication protocols within different bandwidths, antennas are preferably designed to cover multiple bandwidths. Furthermore, antennas are sized smaller and smaller in order to fit portable wireless products that are designed more and more compact.

With reference to FIG. 1, a conventional antenna is F-shaped and comprises a resonant length, a resonant mode, a ground plane (10), a radiating patch (12), a grounding conductor (14), a through hole (15) and a feeding conductor (16). The resonant mode has a bandwidth, a central frequency and a wavelength corresponding to the central frequency. The radiating patch (12) is suspended over the ground plane (10). The grounding conductor (14) is mounted on the ground plane (10) and holds the radiating patch (12). The through hole (15) is defined through the ground plane (10). The feeding conductor (16) is mounted through the through hole (15) and is connected to a circuit on a wireless product. However, the antenna has the resonant length being about a quarter of the wavelength of the resonant mode, which limits the minimal size of the antenna and disallows the antenna to fit some compact portable wireless products.

With reference to FIG. 2, U.S. patent application publication No. 2003/0103010 discloses a "double-band antenna" comprising a patch conductor (2). The patch conductor (2) has a slot, a feed pin (25), a short pin (26) and two current paths (23, 24). The slot is zigzag and defined in the patch conductor (2). Currents running respectively along the current paths (23, 24) stimulate two different resonant modes to create two bandwidths. The double-band antenna may be sized small to fit compact wireless products. However, each bandwidth of the double-band antenna is limited and insufficient.

To overcome the shortcomings, the present invention provides a wide band antenna to mitigate or obviate the aforementioned problems.

SUMMARY OF THE INVENTION

The main objective of the invention is to provide a wide band antenna that has multiple resonant modes and sufficient bandwidths.

A wide band antenna in accordance with the present invention has a ground plane, a dielectric member and a radiating patch. The dielectric member is mounted on the ground plane. The radiating patch is held by the dielectric member, is mounted on the ground plane and has a main conductor, a feeding conductor, a coupling conductor, an extension conductor and a shorting conductor. The main conductor has a first resonant mode. The extension conductor has a second resonant mode. The coupling conductor is capable of feeding high frequency signals into the main conductor and the extension conductor by a capacitive coupling means. With the main conductor, the extension conductor and the coupling conductor, the size of the wide band antenna is effectively reduced.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
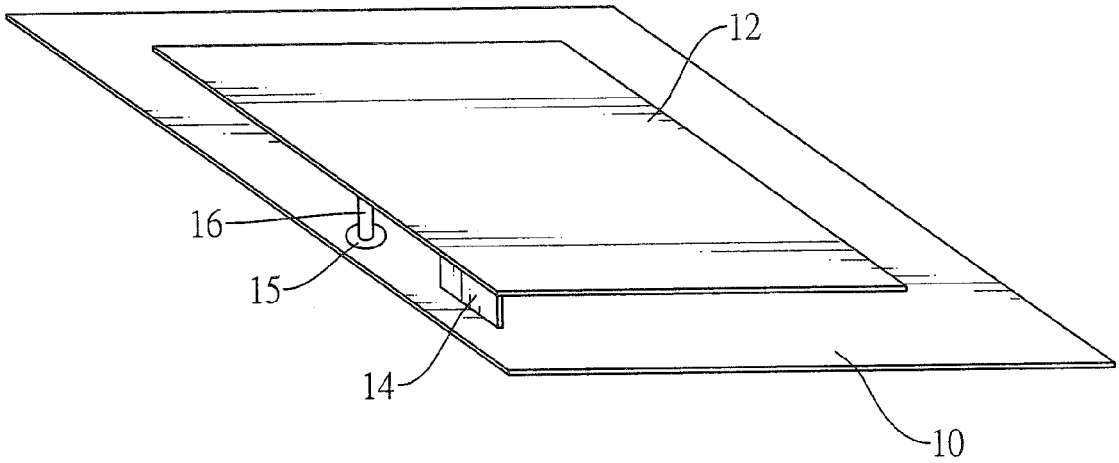
FIG.1 PRIOR ART
FIG. 1 is a perspective view of a conventional antenna in accordance with the prior art.
Figure 2:
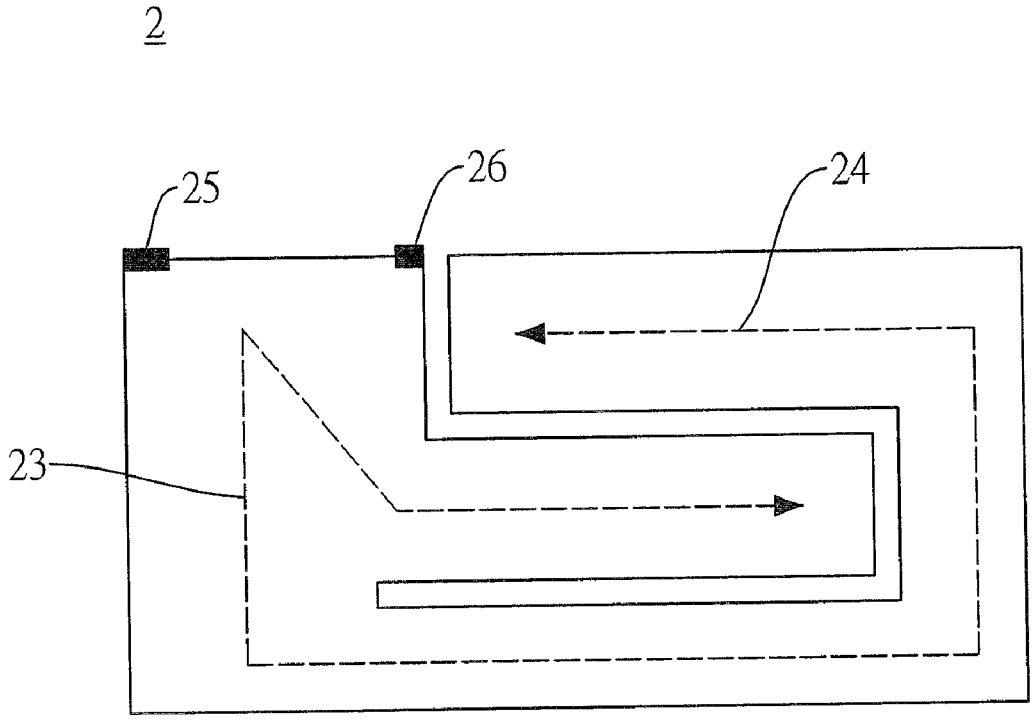
FIG.2 PRIOR ART
FIG. 2 is a top view of a dual-band patch conductor for an another conventional antenna in accordance with the prior art.
Figure 3:
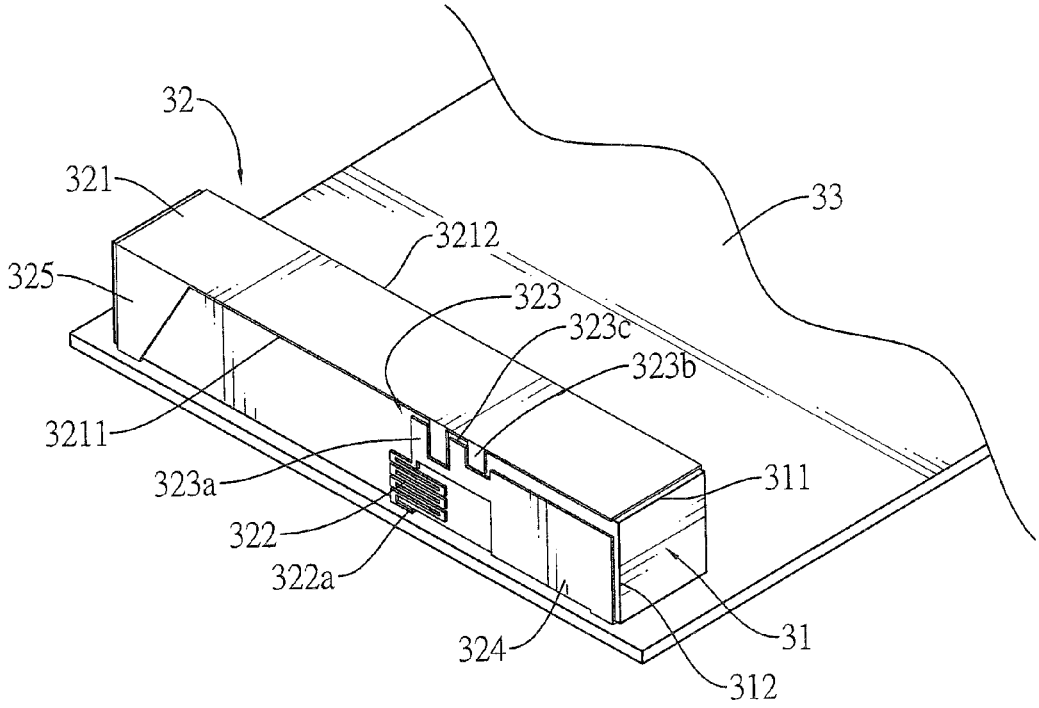
FIG. 3 is a perspective view of a first embodiment of a wide band antenna in accordance with the present invention.
Figure 4:
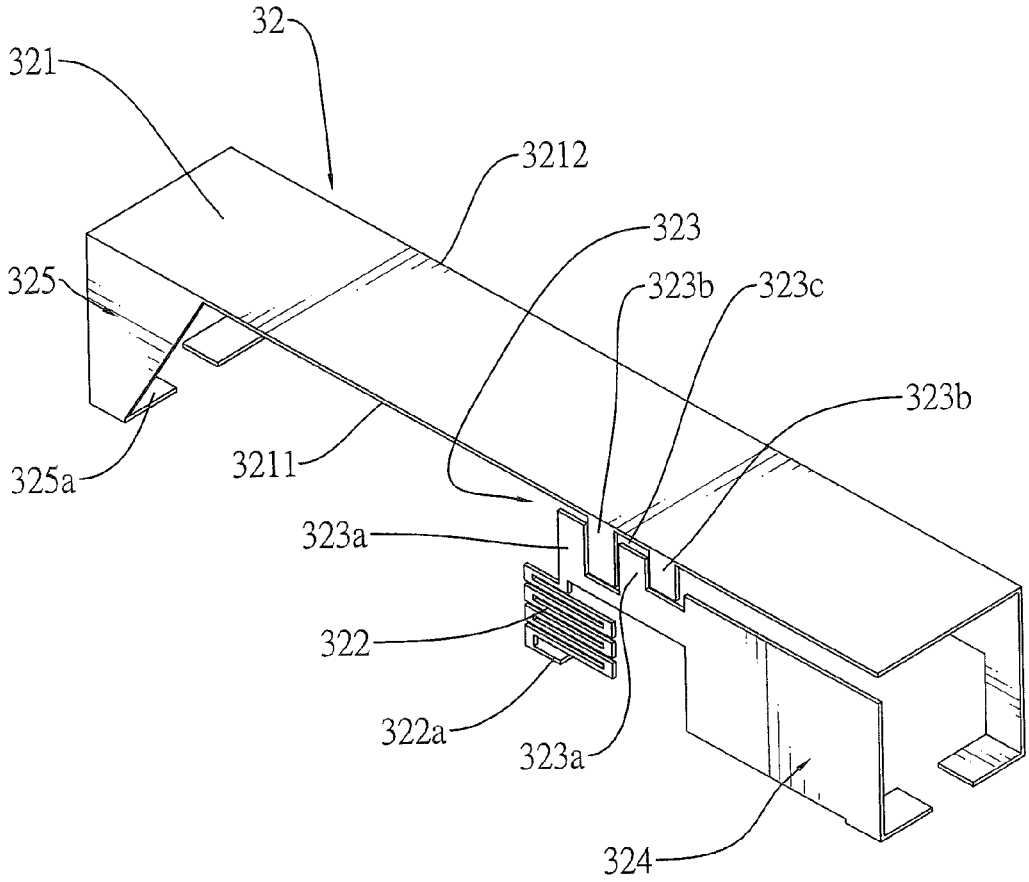
FIG. 4 is an enlarged perspective view of the radiating patch of the wide band antenna in FIG. 3.

With reference to FIGS. 3 and 4, a first embodiment of a wide band antenna in accordance with the present invention comprises a ground plane (33), a dielectric member (31) and a radiating patch (32).

The ground plane (33) is flat and is made of metal.

The dielectric member (31) is insulative and longitudinal, is mounted on the ground plane (33) by surface mount technology (SMT), may be made of microwave dielectric such as ceramics and has a top surface (311), a bottom surface, a first side (312) and a second side and. The bottom surface is mounted on the ground plane (33). The second side is opposite to the first side (312).

The radiating patch (32) is made of metal, is mounted on and supported by the dielectric member (31) and is mounted on the ground plane (33) by SMT. The radiating patch (32) has a main conductor (321), a feeding conductor (322), a coupling conductor (323), an extension conductor (324) and a shorting conductor (325).

Figure 5:
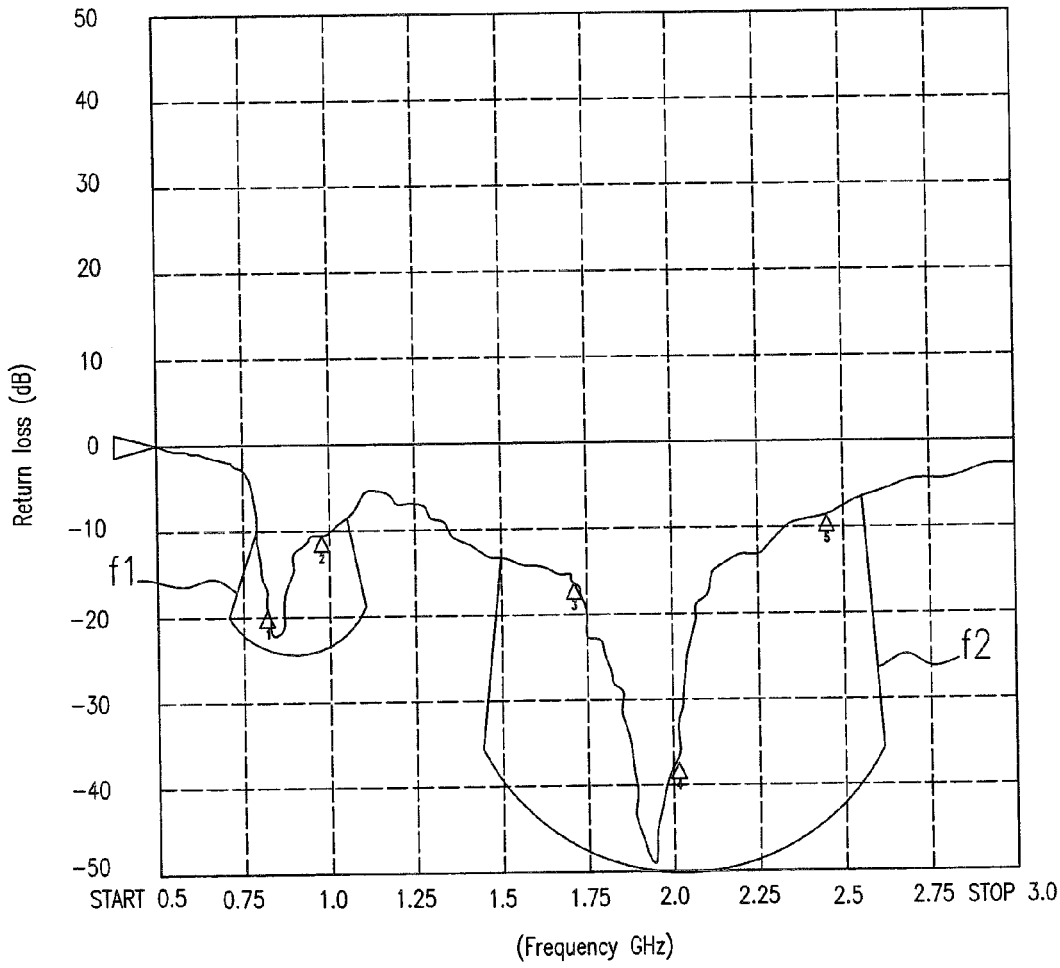
FIG. 5 is a diagram illustrating the relation between frequency and return loss of the wide band antenna in FIG. 3.

With further reference to the diagram of FIG. 5, the main conductor (321) is mounted on the top surface (311) of the dielectric member (31) and provides a main current path. The main conductor (321) has a resonant length, a first resonant mode, two ends, a first edge (3211), a second edge (3212) and a mounting plate. The resonant length corresponds to the main current path. The second edge (3212) is opposite to the first edge (3211). The first resonant mode has a first bandwidth (f1), a central frequency and a wavelength corresponding to the central frequency. The first bandwidth (f1) is a range between upper and lower resonance frequencies and contains wireless communication protocols such as Advanced Mobile Phone System (AMPS, 824-894 MHz) and Global System for Mobile Communications (GSM, 880-960 MHz). With further reference to the diagram of FIG. 5, the central frequency is at a valley about −22 dB of return loss in the first bandwidth (f1).

The mounting plate is formed on and protrudes perpendicularly from the second edge (3212) of the main conductor (321).

The feeding conductor (322) is zigzag, is made of metal, is mounted on the first side (312) of the dielectric member (31) and is capable of generating inductance effect. The zigzag shape of the feeding conductor (322) increases a surface area of the feeding conductor (322) so that the inductance effect is improved. The feeding conductor (322) has a connecting end and a feeding end (322*a*). The feeding end (322*a*) is opposite to the connecting end and may be connected to a circuit of a wireless product so that high frequency signals are transmitted along the feeding conductor (322) through the feeding end (322*a*).

The coupling conductor (323) is made of metal, is mounted on the first side (312) of the dielectric member (31), is connected to the connecting end of the feeding conductor (322) and has a first coupling member, a second coupling member and a gap (323*c*). The first coupling member is formed on and protrudes from the connecting end of the feeding conductor (322) and has a proximal end, a distal end and multiple first keys (323*a*). The distal end is opposite to the proximal end. The first keys (323*a*) are formed on and protrude transversely from the first coupling member toward the main conductor (321) at intervals. The second coupling member is formed on first edge (3211) of the main conductor (321) and has multiple second keys (323*b*) formed on and protruding transversely and perpendicularly from the first edge (3211) of the main conductor (323), extending respectively in the intervals between the second keys (323*b*). The gap (323*c*) is zigzag, is defined through the coupling conductor (323) between the first and second coupling members and separates the first and second coupling members so that the first keys (323*a*) never contacts the second keys (323*b*). The gap (323*c*) has a width that may be less than 3 mm. The first and second coupling members with the gap (323*c*) are capable of generating capacitive coupling effect. The high frequency signals from the feeding conductor (322) are transmitted through the coupling conductor (323) to the main conductor (321) by a capacitive coupling means.

The extension conductor (324) is made of metal, is formed on and protrudes from the distal end of the first coupling member of the coupling conductor (323), is mounted on the first side (312) of the dielectric member (31), may be rectangular, provides a secondary current path and has a resonant length and a second resonant mode. The resonant length of the extension conductor (324) corresponds to the secondary current path. The second resonant mode has a second bandwidth (f2), a central frequency and a wavelength corresponding to the central frequency. The second bandwidth (f2) is a range between upper and lower resonance frequencies, is higher when compared with the first bandwidth (f1) and contains wireless communication protocols such as Global Positioning System (GPS, 1575 MHz), Distributed Control System (DCS, 1710-1880 MHz), PCS (1850-1990 Mhz) and Universal Mobile Telecommunications System (UMTS, 1920-2170 MHz). The central frequency of the second resonant mode is at a valley about −49 dB of return loss in a second frequency range (f2), as shown in FIG. 5. The high frequency signals from the feeding conductor (322) are transmitted through the coupling conductor (323) to the extension conductor (324) by a capacitive coupling means.

The shorting conductor (325) is made of metal, is formed on and protrudes from first edge (3211) of the main conductor (321), is mounted on the first side (312) of the dielectric member (31), is connected to the ground plane (10) and has a shorting contact (325*a*) connected to the ground plane (33).

In the first embodiment, high frequency signals are fed into the main conductor (32) by the capacitive coupling means so that the resonance frequency of the first resonant mode is effectively reduced. Therefore, the main conductor (32) has the resonant length being merely one-eighth of the wavelength corresponding to the central frequency of the first resonant mode to reduce a size of the wide band antenna. Furthermore, high frequency signals are also fed into the extension conductor (324) through the capacitive coupling means so that the resonance frequency of the second resonant mode is effectively reduced. Therefore, the extension conductor (324) has the resonant length being merely one-eighth of the wavelength corresponding to the central frequency of the second resonant mode to reduce the size of the wide band antenna. The zigzag feeding conductor (322) has inductance effect and the coupling conductor (323) has the capacitive effect. Therefore, optimizing a shape of the zigzag feeding conductor (322) and the width of the gap (323*c*) of the feeding conductor (323) greatly improve the impedance matching and increase the bandwidth of the wide band antenna when compared to conventional antenna.

Figure 6:
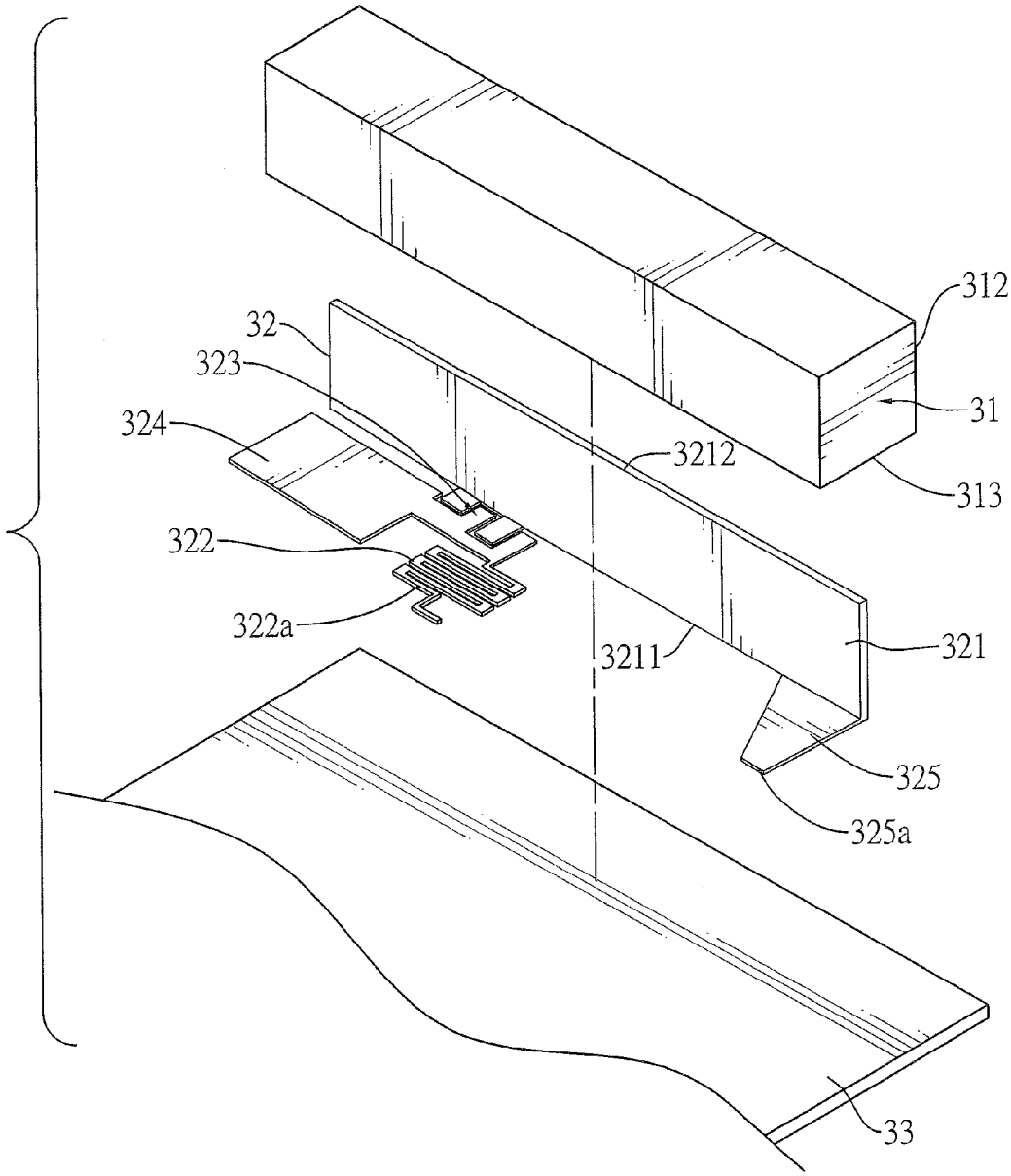
FIG. 6 is an exploded perspective view of a second embodiment of a wide band antenna in accordance with the present invention.

With reference to FIG. 6, a second embodiment of the wide band antenna is similar to the first embodiment and has the main conductor (321) mounted on the first side (312) of the dielectric member (31) and implemented without the mounting plate. The coupling conductor (323), the extension conductor (324) and the shorting conductor (325) are mounted on the bottom surface (313) of the dielectric member (31).

Figure 7:
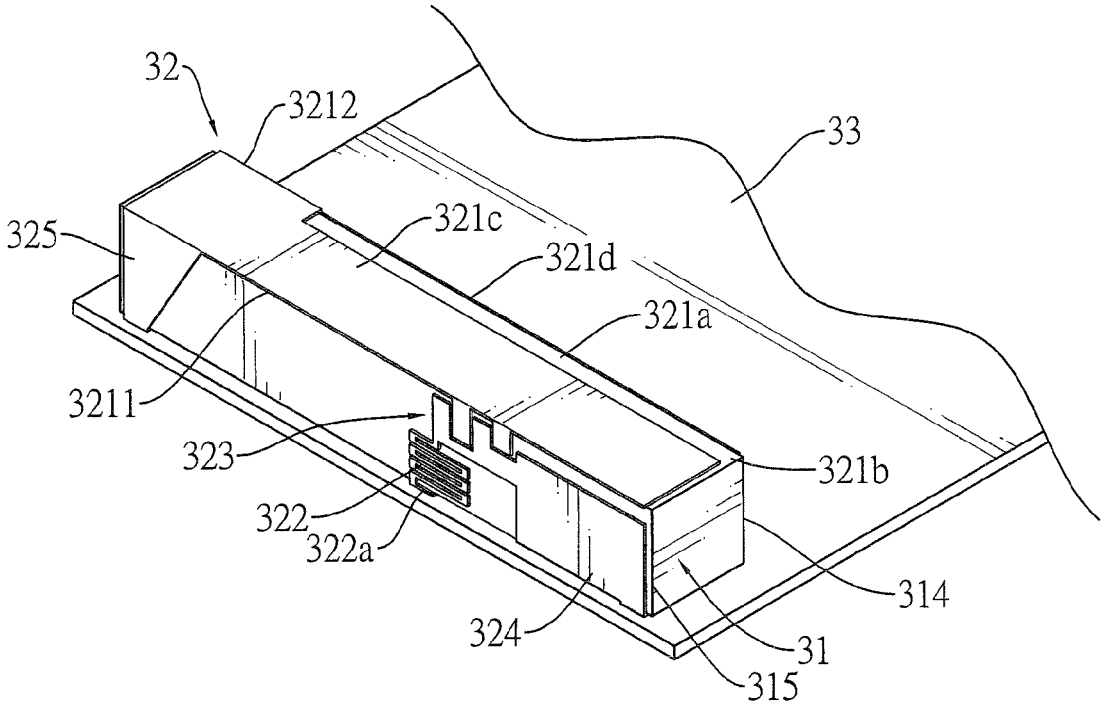
FIG. 7 is a perspective view of a third embodiment of a wide band antenna in accordance with the present invention.

With reference to FIG. 7, a third embodiment of the wide band antenna in accordance with the present invention is similar to the first embodiment and has the main conductor (321) of the radiating patch (32) further having an open slot (321*a*). The open slot (321*a*) is defined in the main conductor (321) adjacent to the second edge of the main conductor (321) and the second side (314) of the dielectric member (324), is located away from the first edge (3211) of the main conductor (321) and the first side (315) of the dielectric member (324) and has a open end (321*b*). The open slot (321*a*) defines a first sub conductor (321*c*) and a second sub conductor (321*d*) formed on the main conductor (321). The first sub conductor (321*c*) is mounted on the top surface (311) of the dielectric member (31). High frequency signals are fed into the first sub conductor (321*c*) of the main conductor (32) by the capacitive coupling means so that the resonance frequency of the first resonant mode is effectively reduced. The second sub conductor (321*d*) is formed on the mounting plate, separates from the first sub conductor (321*c*) and is mounted on the second side (314) of the dielectric member (31). The second sub conductor (321*d*) serves as a parasite antenna and provides a third resonant mode having a third bandwidth. Adjusting a length of the open slot (321*a*) modifies the third bandwidth. The length of the open slot (321*a*) may be shorter than lengths of the first and second sub conductors (321*c*, 321*d*)

Figure 8:
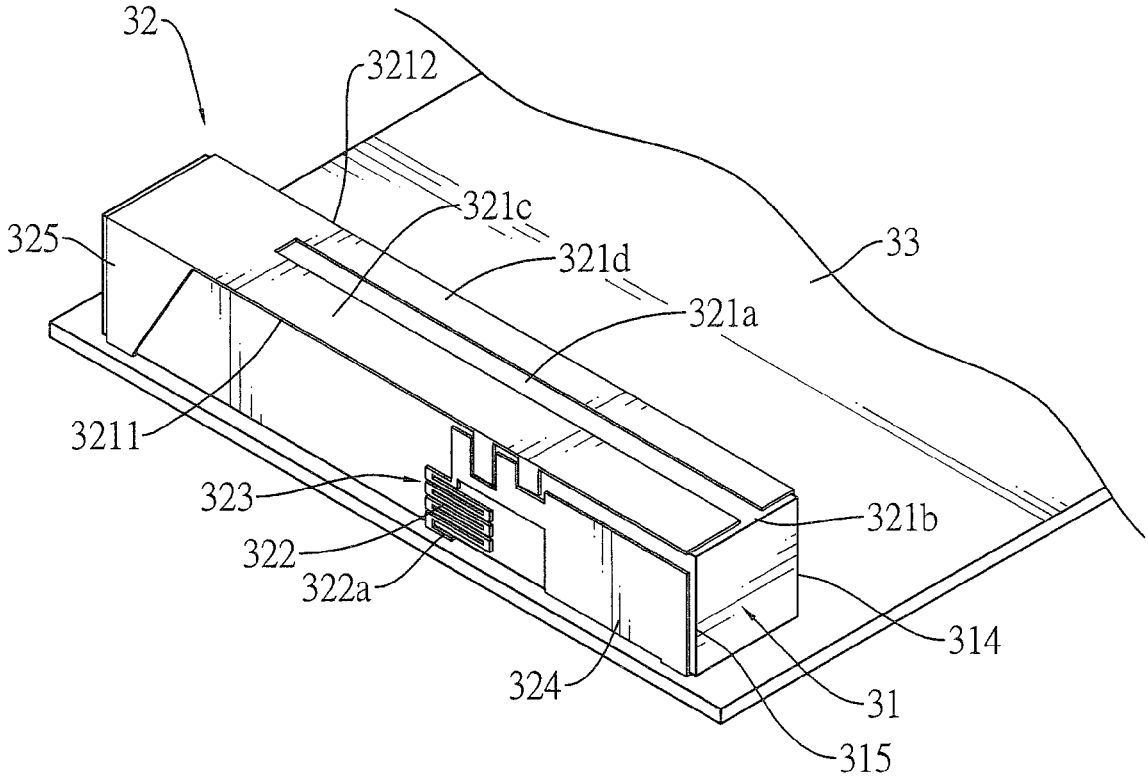
FIG. 8 is a perspective view of a fourth embodiment of a wide band antenna in accordance with the present invention.

With further reference to FIG. 8, a fourth embodiment of the wide band antenna is similar to the third embodiment is similar to the third embodiment and has the open slot (321*a*) defined in a middle section of the main conductor (321). The first and second sub conductors (321*c*, 321*d*) are formed on the main conductor (321) and are both mounted on the top surface (311) of the dielectric member (31).

The wide band antenna has following advantages.

The main conductor (32) has the resonant length being merely one-eighth of the wavelength corresponding to the central frequency of the first resonant mode to reduce a size of the wide band antenna. The extension conductor (324) has the resonant length being merely one-eighth of the wavelength corresponding to the central frequency of the second resonant mode. Therefore, the size of the wide band antenna is effectively reduced.

The zigzag feeding conductor (322) with the inductance effect and the coupling conductor (323) with the capacitive effect increasing the bandwidth of the wide band antenna.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A wide band antenna comprising:

a ground plane;

a dielectric member being mounted on the ground plane and having a top surface, a bottom surface, a first side and a second side being opposite to the first side; and a radiating patch mounted on and supported by the dielectric member, mounted on the ground plane and having a main conductor mounted on the dielectric member and having a resonant length, a first resonant mode, two ends, a first edge and a second edge being opposite to the first edge;

a feeding conductor is mounted on the dielectric member, capable of generating inductance effect and having a connecting end and a feeding end being opposite to the connecting end;

a coupling conductor mounted on the dielectric member, connected to the connecting end of the feeding conductor and having a first coupling member formed on and protruding from the connecting end of the feeding conductor and having a proximal end, a distal end and multiple first keys formed on and protruding transversely from the first coupling member toward the main conductor at intervals;

a second coupling member formed on the first edge of the main conductor and having multiple second keys formed on and protruding transversely and perpendicularly from the first edge of the main conductor, extending respectively in the internals between the second keys; and a gap defined through the coupling conductor between the first and second coupling members, separating the first and second coupling members and having a width;

an extension conductor formed on and protruding from the distal end of the first coupling member of the coupling conductor, mounted on the dielectric member and having a resonant length and a second resonant mode; and a shorting conductor formed on and protruding from the first edge of the main conductor, mounted on the dielectric member and connected to the ground plane.

2. The wide band antenna as claimed in claim 1, wherein the dielectric member is made of a microwave dielectric.

3. The wide band antenna as claimed in claim 2, wherein the dielectric member and the radiating patch are mounted on the ground plane by surface mount technology.

4. The wide band antenna as claimed in claim 3, wherein the ground plane and the radiating patch are made of metal.

5. The wide band antenna as claimed in claim 4, wherein the feeding conductor is zigzag.

6. The wide band antenna as claimed in claim 5, wherein the gap of the coupling conductor is zigzag.

7. The wide band antenna as claimed in claim 6, wherein the width of the gap is less than 3 mm.

8. The wide band antenna as claimed in claim 7, wherein the coupling conductor is capable of feeding high frequency signals into the main conductor and the extension conductor by a capacitive coupling means.

9. The wide band antenna as claimed in claim 8, wherein:

the main conductor is mounted on the top surface of the dielectric member; and the feeding conductor, the coupling conductor, the extension conductor and the shorting conductor are mounted on the first side of the dielectric member.

10. The wide band antenna as claimed in claim 9, wherein the main conductor of the radiating patch further has an open slot defined in the main conductor adjacent to the second edge of the main conductor and the second side of the dielectric member, having an open end and defining a first sub conductor on formed the main conductor and mounted on the top surface of the dielectric member; and a second sub conductor formed on the main conductor, separating from the first sub conductor, mounted on the second side of the dielectric member and serving as a parasite antenna to provide a third resonant mode.

11. The wide band antenna as claimed in claim 10, wherein a length of the open slot is shorter than lengths of the first and second sub conductors.

12. The wide band antenna as claimed in claim 8, wherein:

main conductor is mounted on the first side of the dielectric member;

the coupling conductor, the extension conductor and the shorting conductor are mounted on the bottom surface of the dielectric member.

13. The wide band antenna as claimed in claim 9, wherein the main conductor of the radiating patch further has an open slot defined in a middle section of the main conductor, having an open end and defining a first sub conductor on formed the main conductor and mounted on the top surface of the dielectric member; and a second sub conductor formed on the main conductor, separating from the first sub conductor, mounted on the top surface of the dielectric member and serving as a parasite antenna to provide a third resonant mode.

14. The wide band antenna as claimed in claim 13, wherein a length of the open slot is shorter than lengths of the first and second sub conductors.

* * * * *